US006218998B1

(12) United States Patent
Van Voorhies

(10) Patent No.: US 6,218,998 B1
(45) Date of Patent: Apr. 17, 2001

(54) TOROIDAL HELICAL ANTENNA

(75) Inventor: Kurt Louis Van Voorhies, DeTour Village, MI (US)

(73) Assignee: VorteKx, Inc., DeTour Village, MI (US)

( * ) Notice: Subject to any disclaimer, the term of this patent is extended or adjusted under 35 U.S.C. 154(b) by 0 days.

(21) Appl. No.: 09/136,540

(22) Filed: Aug. 19, 1998

(51) Int. Cl.[7] ..... H01Q 11/12

(52) U.S. Cl. ..... 343/741; 343/742; 343/866

(58) Field of Search ..... 343/741, 742, 343/744, 866, 867

(56) References Cited

U.S. PATENT DOCUMENTS

| | | | |
|---|---|---|---|
| 2,957,103 | 10/1960 | Birdsall | 315/3.6 |
| 3,646,562 | 2/1972 | Acker et al. | 343/720 |

(List continued on next page.)

FOREIGN PATENT DOCUMENTS

| | | | |
|---|---|---|---|
| 548541 | 12/1985 | (AU) | H01Q/7/00 |
| 1186049 | 4/1985 | (CA) | 351/45 |
| 0043591A1 | 7/1981 | (EP) | H01Q/11/08 |

OTHER PUBLICATIONS

Dec. 15, 1994; VanVoorhies, K.L.; *The Segmented Bifilar Contrawound Toroidal Helical Antenna*, vol I–III, Ph.D. Dissertation, 1993 (Abstract published by UMI, Ann Arbor, Michigan, U.S.A., on Dec. 15, 1994, in Vol. 55, Issue 6B of Dissertation Abstracts; included in IDS to U.S. Application Serial No. 08/514,609 filed on Aug. 14, 1995 that issued as U.S. Patent 5,734,353 on Mar. 31, 1998; Released for publication by UMI on Feb. 3, 1999, #9427995).

1987; Garnier, R.C.; *Study of a radio frequency antenna with an edge–slot like structure*, Ph.D. Dissertation, Marquette University, Milwaukee, WI.

1961; Ham, J.M.; Slemon, G. R.; "Time Varying Electric and Magnetic Fields," *Scientific Basis of Electrical Engineering*, John Wiley & Sons, N.Y., pp. 303–305.

1956; Birdsall, C.K., Everhart, T.E.; "Modified Contra–Wound Helix Circuits for High–Power Traveling Wave Tubes," IRE Transactions on Electron Devices, ED–3, Oct., pp. 190–204.

(List continued on next page.)

*Primary Examiner*—Tan Ho
(74) *Attorney, Agent, or Firm*—Kurt L. Van Voorhies

(57) ABSTRACT

In an electromagnetic antenna a continuous conductor comprises a first length portion and a second length portion, the first and second length portions each having a first end and a second end whereby the first end of the first length portion connected to the second end of the second length portion at a first node, and the second end of the first length portion is connected to the first end of the second length portion at a second node. The continuous conductor extends in a generalized helical pattern as a single closed circuit around and over the surface of a generalized toroid, whereby the first length portion 14 thereof has a first helical pitch sense and extends around the major axis of the generalized toroid for a first plurality of turns, and the generalized helical pattern of the second length portion thereof has a second helical pitch sense and extends around the major axis of the generalized toroid for a second plurality of turns, whereby the first and second helical pitch senses are opposite one another. The first and second pluralities are preferably equal to one another, and are both equal to two. The first and second length portions of the continuous conductor are generally contrawound relative to one another, are insulated from one another and overlap one another. The first and second nodes are in proximate location to one another and collectively constitute a port. A signal feed is operatively connected to the port, and first and second signal terminals are operatively connected to the signal feed.

5 Claims, 12 Drawing Sheets

U.S. PATENT DOCUMENTS

| | | | | |
|---|---|---|---|---|
| 4,004,179 | | 1/1977 | Phillips | 315/3.5 |
| 4,622,558 | | 11/1986 | Corum | 343/742 |
| 4,751,515 | * | 6/1988 | Corum | 343/742 |
| 5,442,369 | | 8/1995 | Van Voorhies et al. | 343/742 |
| 5,654,723 | | 8/1997 | Craven et al. | 343/742 |
| 5,734,353 | * | 3/1998 | Van Voorhies | 343/742 |

OTHER PUBLICATIONS

1953; Kandoian, A.G.; Sichak, W.; "Wide–Frequency–Range Tuned Helical Antennas and Circuits", Convention Record of the IRE, 1953 National Convention, Part 2—Antennas and Communications, pp. 42–47.

* cited by examiner

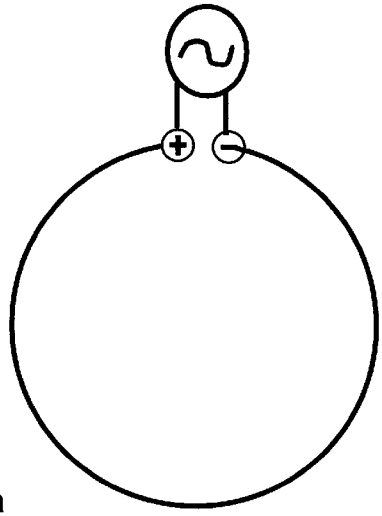
FIG 1a
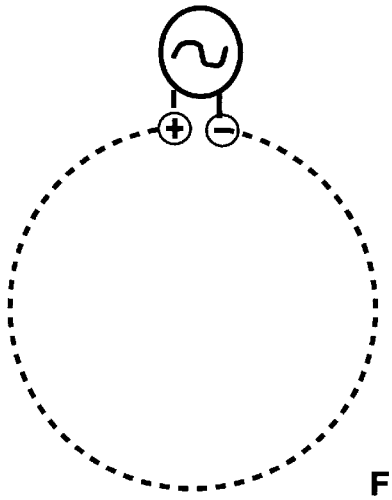
FIG 2a
FIG 1b
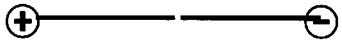
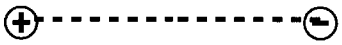
FIG 2b
FIG 1c
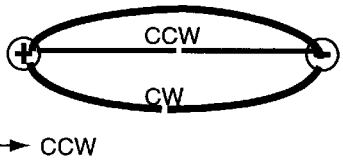
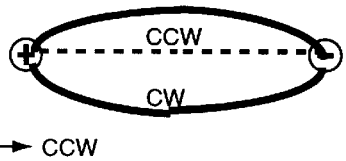
FIG 2c
FIG 1d
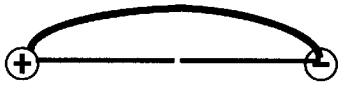
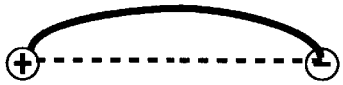
FIG 2d
CCW
CCW
FIG 1e
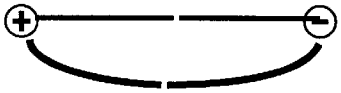
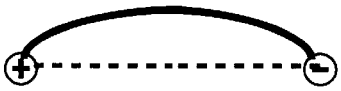
FIG 2e
CCW
CCW

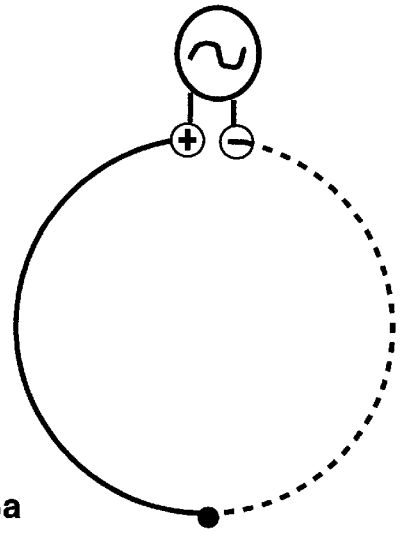
FIG 3a
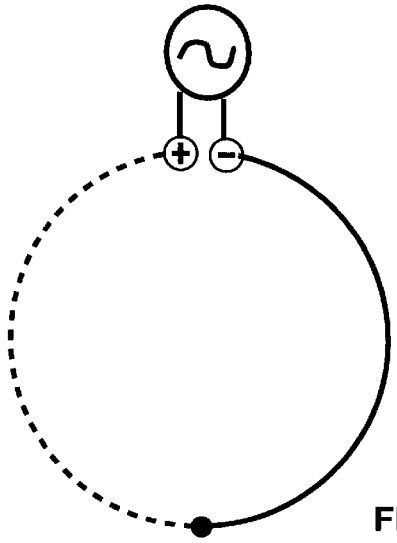
FIG 4a
FIG 3b
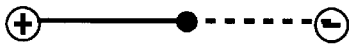
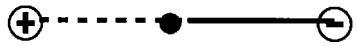
FIG 4b
FIG 3c
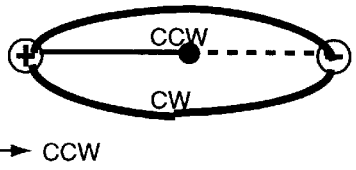
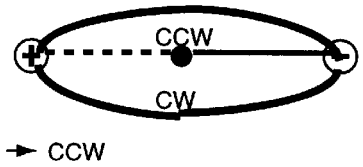
FIG 4c
FIG 3d
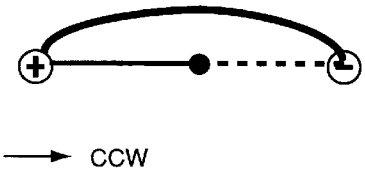
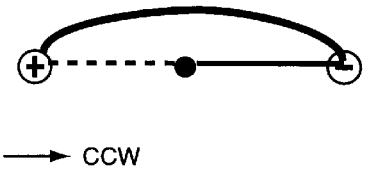
FIG 4d
FIG 3e
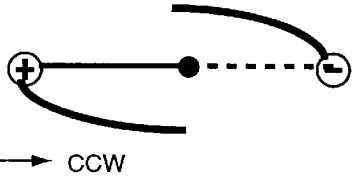
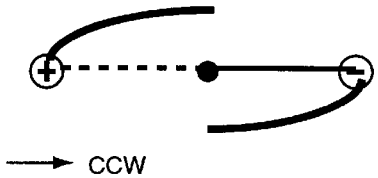
FIG 4e

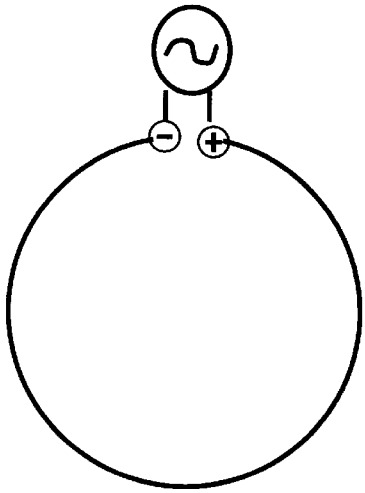
FIG 5a
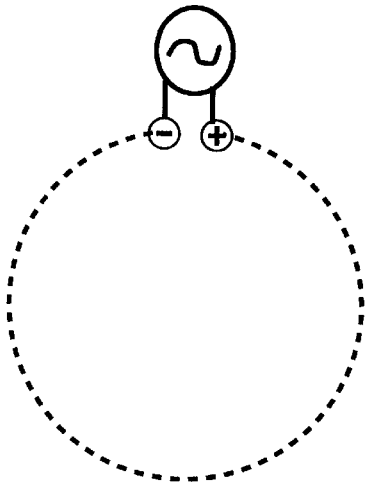
FIG 6a
FIG 5b
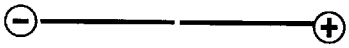
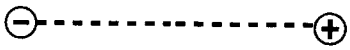
FIG 6b
FIG 5c
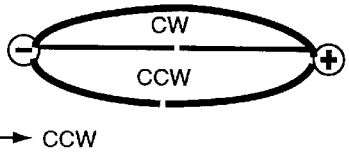
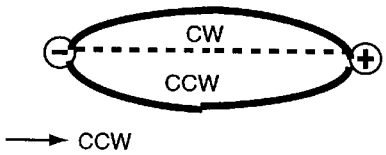
FIG 6c
FIG 5d
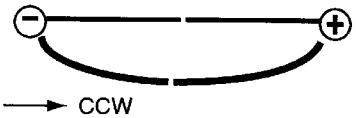
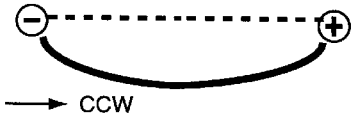
FIG 6d
FIG 5e
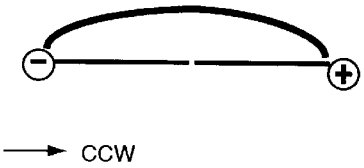
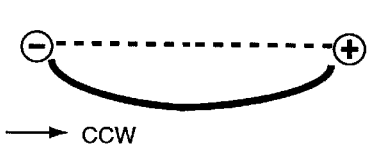
FIG 6e

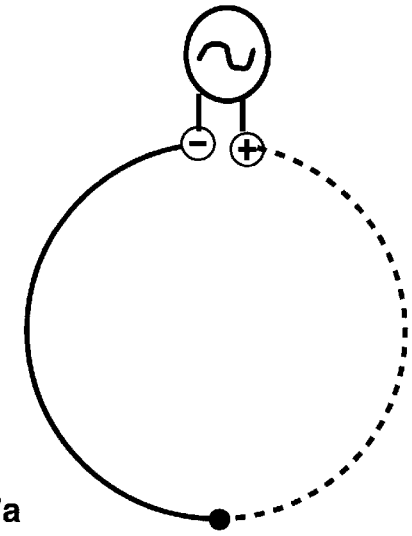
FIG 7a
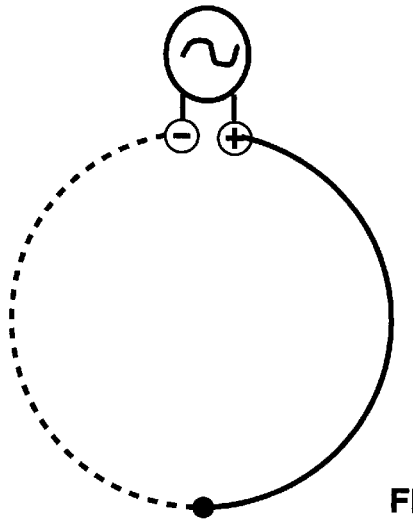
FIG 8a
FIG 7b
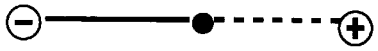
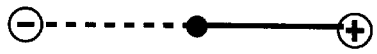
FIG 8b
FIG 7c
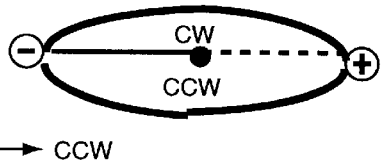
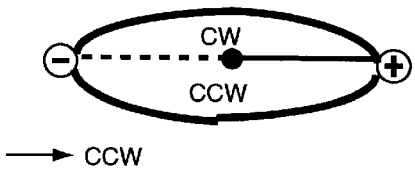
FIG 8c
FIG 7d
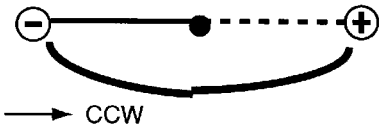
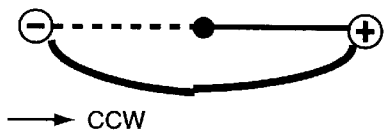
FIG 8d
FIG 7e
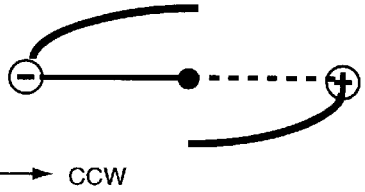
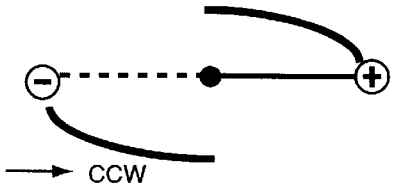
FIG 8e

CCW
CW

CCW

CCW

CCW

CCW
CW

CCW
CW 10, 10.2
24
16.2
20
26
12, 16
18
16.1
22
28

CCW
CW

CCW
CW
CCW

CCW

CCW

CCW
CW
CCW
CW

CCW

CCW

CCW
CW

CCW
CW
CCW
CW

CCW

CCW

CW
CCW
CCW
CW
CCW
CW
CCW

CW
CCW
CCW

CCW

CCW

CW
CW
CCW
CCW 10, 10.1
24
14.2
22
28
26
20
14.1
12, 14
18

CW
CCW

CCW

CCW

CW
CCW
CCW
CW

CW
CCW
CCW

CCW

CCW

CW
CCW
CW
CCW

TOROIDAL HELICAL ANTENNA

CROSS-REFERENCE TO RELATED APPLICATIONS

This provisional application is related in subject matter to pending utility application Ser. No. 08/514,609 entitled Contrawound Toroidal Helical Antenna filed on Aug. 14, 1995 and which issued as U.S. Pat. No. 5,734,353 on Mar. 31, 1998.

TECHNICAL ART

The instant invention generally relates to antennas for transmitting, receiving, or transferring electromagnetic radiation.

BACKGROUND OF THE INVENTION

The performance of electromagnetic antennas is measured with respect to the distance in a given direction or set of directions over which a given amount radio frequency (RF) power applied to the antenna's input terminals can propagate while having a signal strength above a given threshold. Performance is also measured with respect to the frequency bandwidth over which this can occur. An antenna comprises a collection of radiating elements which convert electrical energy to radiating photons, and the geometry and size of these elements determine the intrinsic radiation pattern of the antenna, representing the distribution of radiated power as a function of angular orientation with respect to the coordinate system in which the antenna is located. The radiation pattern indicates the ability of the antenna to concentrate energy along a given direction or set of directions, and the orientation of the peak of the radiation pattern gives the direction over which the propagation distance in free space will be greatest. The efficiency of the radiation process—i.e. the process of converting electrical energy to radiating photons—is dependent upon the operating frequency and is measured by what is termed here a radiation bandwidth. An antenna also exhibits a frequency dependent complex impedance at its input port or ports which affects the ability of the antenna to absorb power from a given source. This frequency dependency of the input impedance is characterized by the antenna's input impedance bandwidth. The net bandwidth of the antenna is dependent upon both the radiation bandwidth and the impedance bandwidth. An electrical matching network is generally placed between the antenna input port and the feed source to match the impedance of the antenna to that of the power source so as to maximize the amount of real power conducted into and absorbed by the antenna. Some of this absorbed real power is converted to heat due to ohmic losses in the conductive elements comprising the antenna, while the remainder is radiated by the antenna. The impedance bandwidth at the input to the matching network is generally different from that of the antenna. The performance of an antenna is dependent upon the ability of the antenna to absorb electrical energy conducted into the antenna input port, as indicated by the input impedance and impedance bandwidth, and upon the ability of the antenna to convert the conducted electrical energy to radiating photons, as indicated by the radiation pattern and radiation bandwidth. In operation, the orientation of the antenna, and with that the antenna's radiation pattern, relative to that of a given receiving antenna, will affect the maximum propagation distance that can be achieved for a given communications link between the two antennas.

The direction of polarization of an electromagnetic wave is given by the direction of the corresponding electric field component. If the direction of polarization is fixed, the wave is said to be linearly polarized, while if the direction of polarization rotates about the axis of wave propagation, the wave is said to be circularly polarized. The arts pertaining to electromagnetic radiation and propagation generally recognize that electromagnetic waves of a given energy which are linearly polarized in a vertical direction relative to the Earth's surface, i.e. vertically polarized, will propagate farther than corresponding electromagnetic waves of other polarizations. Vertically polarized waves are commonly created with resonant dipoles, or grounded quarter wave monopoles, oriented along a vertical axis. For a dipole, the length of the antenna at resonance—the operating frequency for greatest efficiency—is such that the antenna supports one half of a standing wave. While propagating on or along the antenna structure, the wave is referred as a guided wave, and the guided wavelength is generally about 95% of the free space wavelength for an electric dipole. The length of a resonant quarter-wave monopole will be one quarter of a guided wavelength. The physical size, especially the length, of these resonant dipole and monopole antennas can be a significant disadvantage, especially at low frequencies and for applications requiring a portable, vehicular mounted antenna.

A number of alternative means have been devised for reducing the size, or more particularly the length, of resonant dipole or monopole antennas. When operated at non-resonant frequencies, and particularly at frequencies where the resonant dipole or monopole antenna is electrically short or small, i.e. where the physical length of the antenna is shorter than the corresponding half or quarter guided wavelength, the input impedance becomes complex and likely unmatched to the power source, thereby reducing the amount of power that can be absorbed by the antenna. Matching circuits can be used to compensate for this effect and to thereby increase the efficiency of electrically short antennas, and these matching circuits can comprise either passive or active electrical networks. A dipole or monopole antenna can also be constructed with helically wound conductors, whereby the resonance length is governed by the length of the wire and the velocity factor of the helical wave guiding structure, while the antenna length is governed by the overall, and generally significantly shorter, length of the helix. A plurality of electrically short dipole or monopole antennas may also be operated as a phased array to as to concentrate the radiation power in a given direction. The benefits of reduced size in these alternative configurations, however, are generally obtained with the disadvantage of either reduced gain, or increased complexity or cost.

A low profile, i.e. short, vertically polarized antenna would be useful for a number of applications. These applications include portable communications equipment, such as on air, sea and land vessels and vehicles; where the physical length of a protruding antenna could either adversely affect aerodynamic drag, interfere with obstacles, or be overly conspicuous. These applications could also include low frequency land based communications where the height of the antennas is hazardous to aircraft and undesirable to neighboring residents. These tall antennas are also expensive to build and to maintain.

The radiation from an electric dipole or monopole antenna results from the spatial distribution of electric currents associated with the associated standing current waves on the antenna structure. The electric currents oscillate along the linear path of the antenna, and the direction of electric current corresponds to the direction of polarization of the resulting associated radiated wave. Applying the principle of duality of electromagnetic fields, a vertically polarized antenna can also be constructed in principle by replacing electric current sources with their equivalent magnetic current sources, where magnetic current is proportional to the time rate of change of the magnetic flux density B. A loop of uniform magnetic current is roughly equivalent to a linear electric current, whereby the axis of the loop of magnetic current is coincident with the line defining the linear electric current. Therefore for duality with an electric dipole or monopole antenna, the corresponding magnetic loop would be located in a plane normal to the electric dipole or monopole antenna. For a vertically polarized dipole or monopole, the magnetic loop will be in the horizontal plane.

Magnetic loop currents can be created with toroidal helical structures. An elementary toroidal helix comprises a single helical conductor which follows a path along the surface of a torus. The defining toroidal surface has a major axis and a minor axis, and corresponding radii. The major axis is normal to the plane of the torus, while the minor axis forms a circle whose radius is equal to the major radius of the torus. The toroidal surface is then defined as that surface whose distance from the minor axis is equal to the minor radius of the torus. The resonance properties of the toroidal helical structure are related to the length of the conductor, and the geometry of is associated toroidal helix. The physical height of this structure, when oriented in a horizontal plane as necessary for vertical polarization, is governed by the minor diameter of the toroidal helical structure. Since this height is generally significantly smaller than the corresponding resonant half or quarter wavelength, this structure has a low physical profile relative to that of a corresponding dipole or monopole antenna.

The prior art teaches various applications of elementary toroidal helical antennas. Ham, J. M. and Slemon, G. R. in *Scientific Basis for Electrical Engineering,* John Wiley & Sons, N.Y., 1961, 303–305 illustrate the use of the electric field created along the major axis of an elementary toroidal helix for accelerating charged particles. U.S. Pat. No. 3,646,562 teaches the use of an elementary toroidal helical coil to couple RF energy into a live tree via the electric field created along the major axis of the elementary toroidal helical coil for purposes of using a tree as a large antenna. While simple in construction, a disadvantage of the elementary toroidal helix is that in addition to creating a loop of magnetic current, the elementary toroidal helix also creates an associated loop of electric current, whereby the combined effects of the electric and magnetic loop currents produces a composite radiation pattern which differs from that of an electric dipole, and more particularly the radiated field contains both vertical and azimuthal components.

U.S. Pat. Nos. 4,622,558 and 4,751,515; related Australian Patent Application 548,541; and Canadian Patent 1,186,049 have disclosed three different groups of embodiments—referred as groups of prior art embodiments, infra—for canceling the azimuthal component of radiation gain present in the elementary toroidal helical antenna.

The first group of prior art embodiments comprise a plurality of closed interconnected ring elements, which are based upon the modified contrawound helix disclosed for use in traveling wave tubes by Birdsall, C. K. and Everhart, T. E. in "Modified Contra-Wound Helix Circuits for High-Power Traveling-Wave Tubes," *IRE Transactions on Electron Devices,* ED-3 (October 1956), 190–204. A typical linear contrawound helix comprises two coaxial helical windings, the helical pitch senses of each which are opposite to one another. If the electric currents in the separate windings are in phase, called the symmetric mode of operation, then the associated axial magnetic fields created by the separate helical winding elements cancel one another, while the corresponding electric fields reinforce one another. If the electric currents in the separate windings are of opposite phase, called the anti-symmetric mode of operation, then the axial magnetic fields reinforce one another, while the axial electric fields cancel one another. When applied to traveling wave tubes, the contrawound helix is normally operated in the symmetric mode. The modified contrawound helix of Birdsall and Everhart comprises a single conductor disposed as a series of poloidal ring elements interconnected with axial bar elements. At resonance, this modified contrawound helix operates similar to a bifilar contrawound helix. The condition for this mode of operation is that the circumferential length of the ring elements be on the order of a half wavelength. The first group of embodiments utilize a series of four modified contrawound helical elements disposed on a toroidal surface, whereby each element is fed in phase from a common signal source, and whereby each element would operate in the anti-symmetric mode so as to create a loop of quasi-uniform magnetic current without an associated loop of electric current.

The second group of prior art embodiments utilize first and second substantially closed, elongated conductors helically wound in bifilar relation on same toroidal surface. The conductors in these embodiments are shown having a continuous pitch sense. A given pair of windings is shown fed at diametrically opposite points on the toroidal helical structure, and a phase shift network is described in conduction with an embodiment having four toroidal helical conductors that are wound in parallel with a common, continuous helical pitch sense.

The third group of prior art embodiments are image plane variants of first group of prior art embodiments, supra, sectioned along the plane of the minor axis of the toroidal structure and including an image plane coincident with the sectioning plane. These embodiments utilize the principle of electrical imaging whereby a conductive image plane creates the electrical equivalent to the mirror image of the physical antenna structure above the image plane.

The associated toroidal helical structure for all three groups of prior art embodiments is taught to be at least one guided wavelength in circumference. The associated teachings also describe how the antennas are sized for a given operating frequency according to the relations from Kandoian, A. G. and Sichak, W., "Wide-Frequency-Range Tuned Helical Antennas and Circuits," *Convention Record of the IRE,* 1953 *National Convention, Part* 2— *Antennas and Communications*, pp. 42–47 for the propagation properties of waves on linear helical structures based upon the results from infinite sheath helices. However, U.S. Pat. application Ser. No. 07/992,970, infra, discloses that these relations were found to be in error by as much as a factor of 2 to 3 when applied to the operation of bifilar contrawound helical elements. The design relations for a toroidal helical antenna structure are used to determine the size and helical pitch of the associated toroidal helix for a given frequency of operation. The first and third groups of prior art embodiments also have the implicit limitation according to the theory of modified contrawound toroidal helical structures that the circumference of the rings must be on the order of a half wavelength in order to operate as a vertically polarized antenna. Since the ring diameter establishes the antenna height, this can be a constraining factor for some applications.

The prior art teaches the use of edge-slot structures for creating omnidirectional vertically polarized radiation fields wherein, according to Garnier, R. C., Study of a Radio Frequency Antenna with an Edge-Slot Like Structure, Ph.D. Dissertation, Marquette University, 1987, UMI Order Number 8716862 (which references U.S. Pat. No. 4,051,480) a toroidal shell structure with an circular resonant peripheral slot gap is fed from a pair of central internal nodes from inside the shell. This results in poloidal conduction currents on the shell structure in series with a displacement current across the peripheral slot, in contradistinction to the toroidal helical structures for which the currents are conducted by toroidal helical windings and for which there are no gaps in series with the conductive elements and across which must flow displacement currents.

An improved toroidal helical antenna is disclosed in U.S. Pat. application Ser. No. 07/992,970 now U.S. Pat. No. 5,442,369. This antenna uses a bifilar contrawound toroidal helical winding divided into four equi-angular segments each segment of which is one quarter guided electrical wavelength in length, wherein the helical pitch sense is reversed across segment boundaries, the junctions at segment boundaries comprise feed ports, and where the signal is fed at each of the feed ports. A two segment embodiment with a circumference of a half wavelength is also disclosed, for which the signal is simultaneously fed at two feed ports. These embodiments utilize multiple parallel feeds and corresponding feed matching networks. The contrawound helical windings are operated in an anti-symmetric mode wherein the magnetic loop currents created thereby are reinforced, and the associated loop electric current components effectively cancel one another. This improved toroidal helical antenna theoretically has a pure linear radiation polarization along the major axis of the associated toroid form, with near omnidirectionality in the azimuthal plane, and is not constrained to having a poloidal circumference of approximately one half wavelength as required of toroidal antenna embodiments constructed with ring-bar style modified contrawound helix windings, supra.

The improved toroidal helical antenna, supra, however, requires multiple, parallel signal feeds which are more complex to match and tune than would be a single feed port, because the separate feed networks can influence the operation of the antenna and can interact with one another. Also, the four segment embodiment of this antenna is one electrical wavelength in circumference. The two segment embodiment, while only a half wavelength in circumference, also requires multiple simultaneous feeds and operates at a low impedance resonance condition which has inherently lower bandwidth than the high impedance resonance condition at which the four segment embodiment operates.

U.S. Pat. No. 5,734,353, the '353 Patent, teaches an electrically small contrawound toroidal helical antenna comprising a single conductor with two length portions in overlapping contrawound relationship to one another. Electrical currents in the individual length portions travel in opposite circumferential directions around the toroid, so that the net circumferential electric current around the toroid is effectively zero. However, because of the contrawound helical relationship, the associated circumferential magnetic current components created by the respective electric current components in each of the toroidal helical length portions reinforce, so that the resulting radiation pattern is similar to that of an electric dipole that was coincident with and centered along the major axis of the torus. In other words, the resulting radiation pattern is strongly linearly polarized in a direction parallel to the major axis of the toroid. Depending upon the construction of the antenna, particularly the aspect ratio of the underlying torus form and the number of helical turns, other polarization components may also be present.

The '353 Patent, incorporated by reference herein, teaches a schematic symbolism for representing generalized helical and generalized toroidal helical windings as solid or dashed lines, the former representing a left had pitch sense, the later representing a right hand pitch sense, wherein the axial direction of the associated magnetic current and the projected axial direction of the associated electric current are the same for a right hand pitch sense helix, and opposite for a left-hand pitch sense helix. The radiation pattern of an electromagnetic antenna can be related to the effective electric and magnetic current distributions created by the antenna. For example, a uniform ring of magnetic current with no associated electric currents corresponds to the radiated electromagnetic field distribution of an electric dipole antenna. Furthermore, a uniform ring of electric current with no associated magnetic currents approximates the radiation pattern of a "Smith Cloverleaf" antenna. The radiation pattern for a particular set of current distributions can determined by either simulation or measurement.

In an exemplary mode of operation, the antenna is operated at a frequency such that the circumferencial length of the antenna is one half of an electrical wavelength. The slow wave properties of the contrawound helix make the corresponding physical length shorter than the free space wavelength according to the associated velocity factor, which depends upon the associated underlying helix geometry.

SUMMARY OF THE INVENTION

The instant invention teaches a variety of embodiments for creating various electric and magnetic current distributions, each having an associated electromagnetic radiation pattern and polarization.

A fundamental element of the antenna comprises a generalized toroidal helix constructed from a single conductive path having a continuous generalized helical pitch sense. The generalized toroidal helix so constructed extends circumferentially around the generalized toroidal form one or more times, whereby each full circumferential segment is referred as a layer.

Another fundamental element of the antenna comprises a generalized toroidal helix constructed from a single conductive path having two length portions, whereby each length portion has a continuous generalized helical pitch sense, and the helical pitch senses of the respective length portions are opposite to one another. The generalized toroidal helix so constructed extends circumferentially around the generalized toroidal form one or more times, whereby each full circumferential segment is referred as a layer.

The above described fundamental elements are used either individually or combined with one another to form a variety of antennas each of which can be appropriately realized as having single conductive path.

For the same resonance conditions, e.g. fundamental resonance, the multi-layer embodiments will be physically smaller than the associated single layer embodiments.

These and other objects, features, and advantages of the instant invention will be more fully understood after reading the following detailed description of the preferred embodiment with reference to the accompanying drawings and viewed in accordance with the appended claims.

BRIEF DESCRIPTION OF THE DRAWINGS

FIG. 1 is a schematic representation of a single layer uniform left-hand pitch sense toroidal helical antenna embodiment series fed at a resonant frequency according to a first signal feed configuration wherein at the depicted instant of time the first signal feed terminal is positive with respect to the second signal feed terminal; also known as the single layer "PSS" configuration.

FIG. 2 is a schematic representation of a single layer uniform right-hand pitch sense toroidal helical antenna embodiment series fed at a resonant frequency according to a first signal feed configuration wherein at the depicted instant of time the first signal feed terminal is positive with respect to the second signal feed terminal; also known as the single layer "PDD" configuration.

FIG. 3 is a schematic representation of a single layer toroidal helical antenna embodiment divided into first and second length portions joined to one another wherein the first length portion is a left-hand pitch sense helix and the second length portion is a right-hand pitch sense helix, series fed at a resonant frequency according to a first signal terminal, configuration wherein at the depicted instant of time the first signal feed terminal, connected to the first length portion, is positive with respect to the second signal feed terminal, connected to the second length portion; also known as the single layer "PSD" configuration.

FIG. 4 is a schematic representation of a single layer toroidal helical antenna embodiment divided into first and second length portions joined to one another wherein the first length portion is a right-hand pitch sense helix and the second length portion is a left-hand pitch sense helix, series fed at a resonant frequency according to a first signal feed configuration wherein at the depicted instant of time the first signal feed terminal, connected to the first length portion, is positive with respect to the second signal feed terminal, connected to the second length portion; also known as the single layer "PDS" configuration.

FIG. 5 is a schematic representation of a single layer uniform left-hand pitch sense toroidal helical antenna embodiment series fed at a resonant frequency according to a second signal feed configuration wherein at the depicted instant of time the first signal feed terminal is negative with respect to the second signal feed terminal; also known as the single layer "NSS" configuration.

FIG. 6 is a schematic representation of a single layer uniform right-hand pitch sense toroidal helical antenna embodiment series fed at a resonant frequency according to a second signal feed configuration wherein at the depicted instant of time the first signal feed terminal is negative with respect to the second signal feed terminal; also known as the single layer "NDD" configuration.

FIG. 7 is a schematic representation of a single layer toroidal helical antenna embodiment divided into first and second length portions joined to one another wherein the first length portion is a left-hand pitch sense helix and the second length portion is a right-hand pitch sense helix, series fed at a resonant frequency according to a second signal feed configuration wherein at the depicted instant of time the first signal feed terminal, connected to the first length portion, is negative with respect to the second signal feed terminal, connected to the second length portion; also known as the single layer "NSD" configuration.

FIG. 8 is a schematic representation of a single layer toroidal helical antenna embodiment divided into first and second length portions joined to one another wherein the first length portion is a right-hand pitch sense helix and the second length portion is a left-hand pitch sense helix, series fed at a resonant frequency according to a second signal feed configuration wherein at the depicted instant of time the first signal feed terminal, connected to the first length portion, is negative with respect to the second signal feed terminal, connected to the second length portion; also known as the single layer "NDS" configuration.

DETAILED DESCRIPTION OF THE PREFERRED EMBODIMENT(S)

Figures 9A, 9B, 9C, 9D, 9E, 9F, 9G, 9H, 9I, 9J, 9K, 9L, 9M:
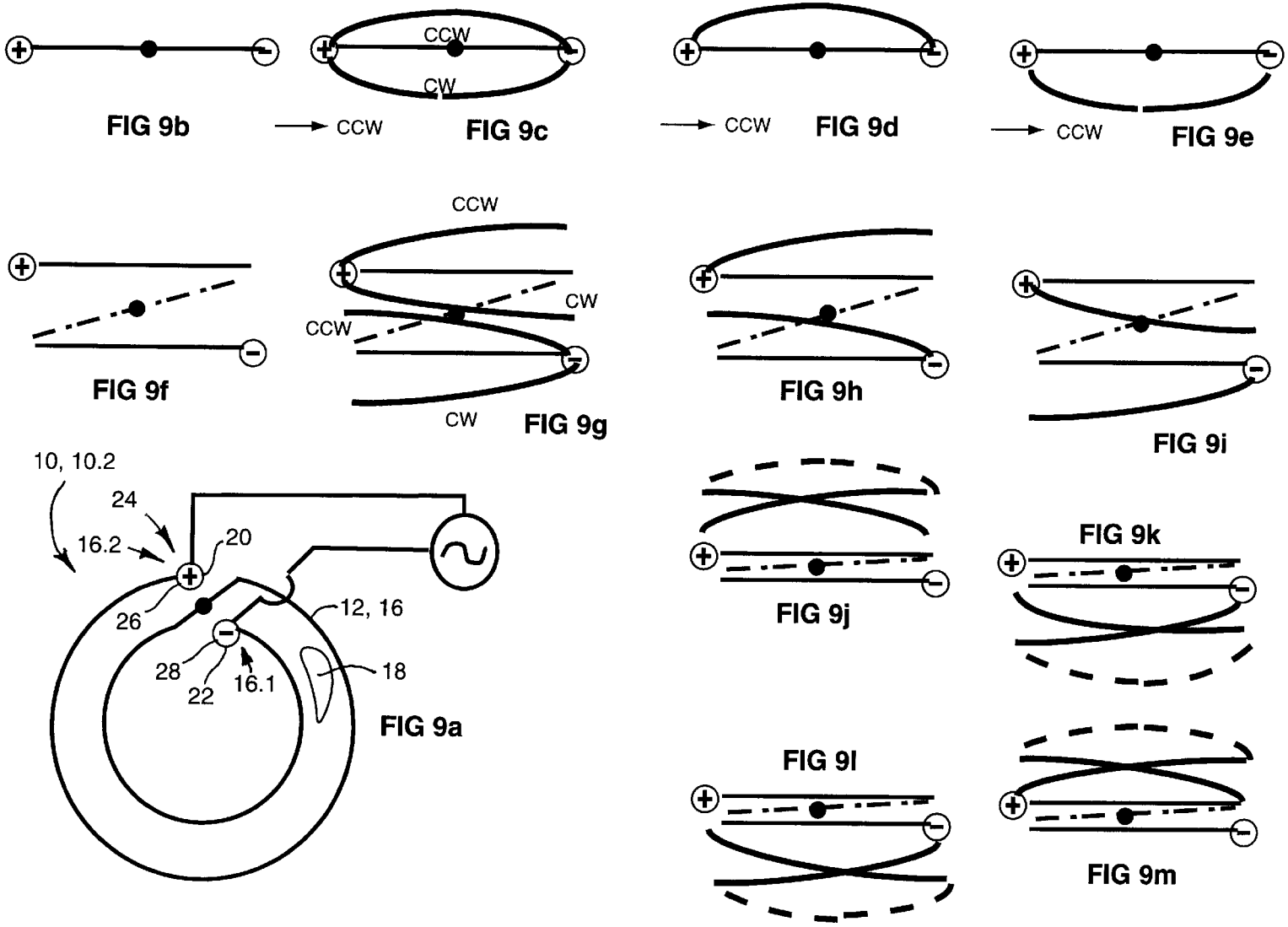
FIG. 9 is a schematic representation of a multi-layer (2-layer) uniform left-hand pitch sense toroidal helical antenna embodiment, wherein each layer spans the entire circumferential length of the underlying generalized toroidal form, series fed at a resonant frequency according to a first signal feed configuration wherein at the depicted instant of time the first signal feed terminal is positive with respect to the second signal feed terminal; also known as the multi-layer "PSS" configuration.
Figures 10A, 10B, 10C, 10D, 10E, 10F, 10G, 10H, 10I, 10J, 10K, 10L, 10M:
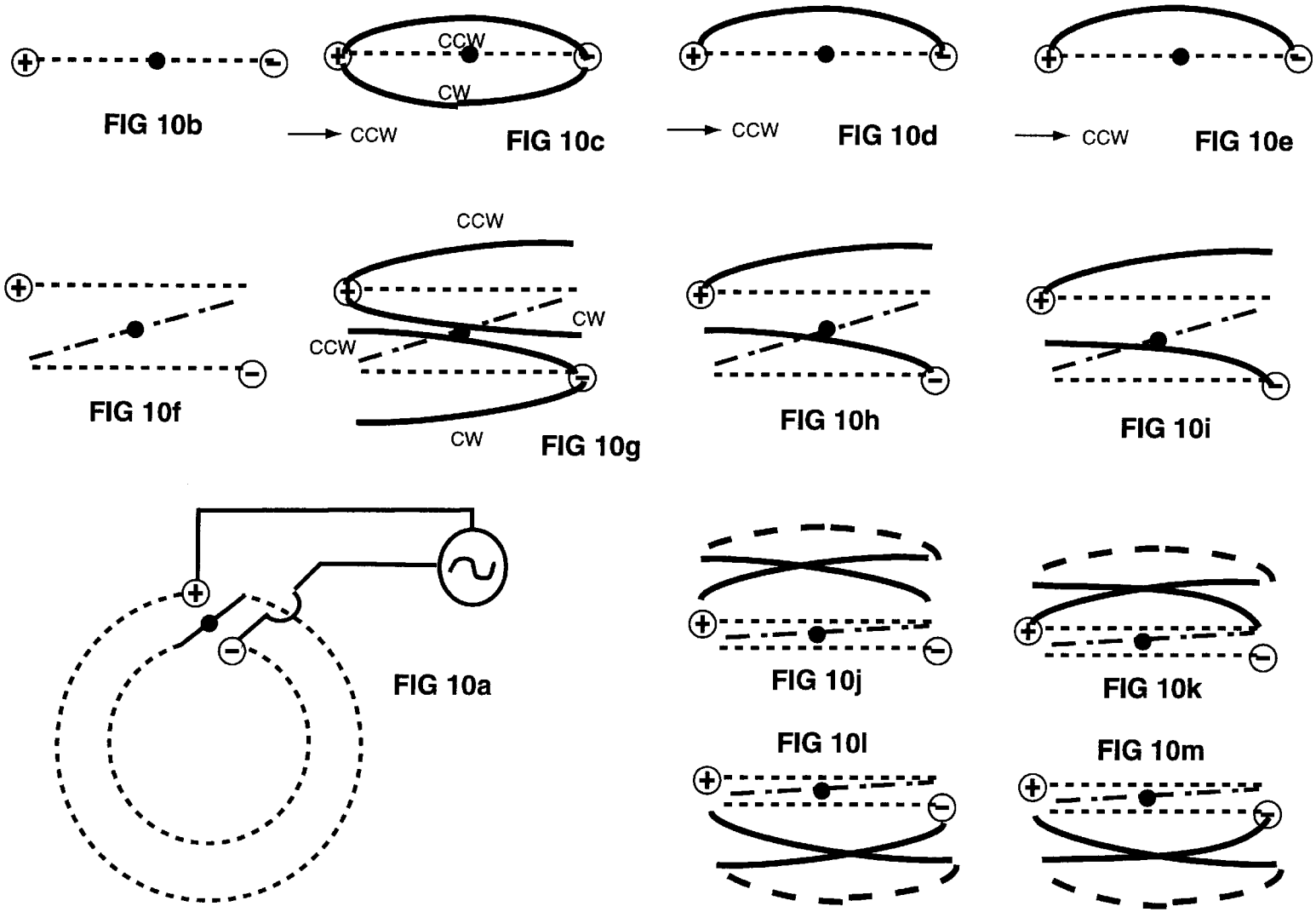
FIG. 10 is a schematic representation of a multi-layer (2-layer) uniform right-hand pitch sense toroidal helical antenna embodiment, wherein each layer spans the entire circumferential length of the underlying generalized toroidal form, series fed at a resonant frequency according to a first signal feed configuration wherein at the depicted instant of time the first signal feed terminal is positive with respect to the second signal feed terminal; also known as the multi-layer "PDD" configuration.
Figures 11A, 11B, 11C, 11D, 11E, 11F, 11G, 11H, 11I, 11J, 11K, 11L, 11M:
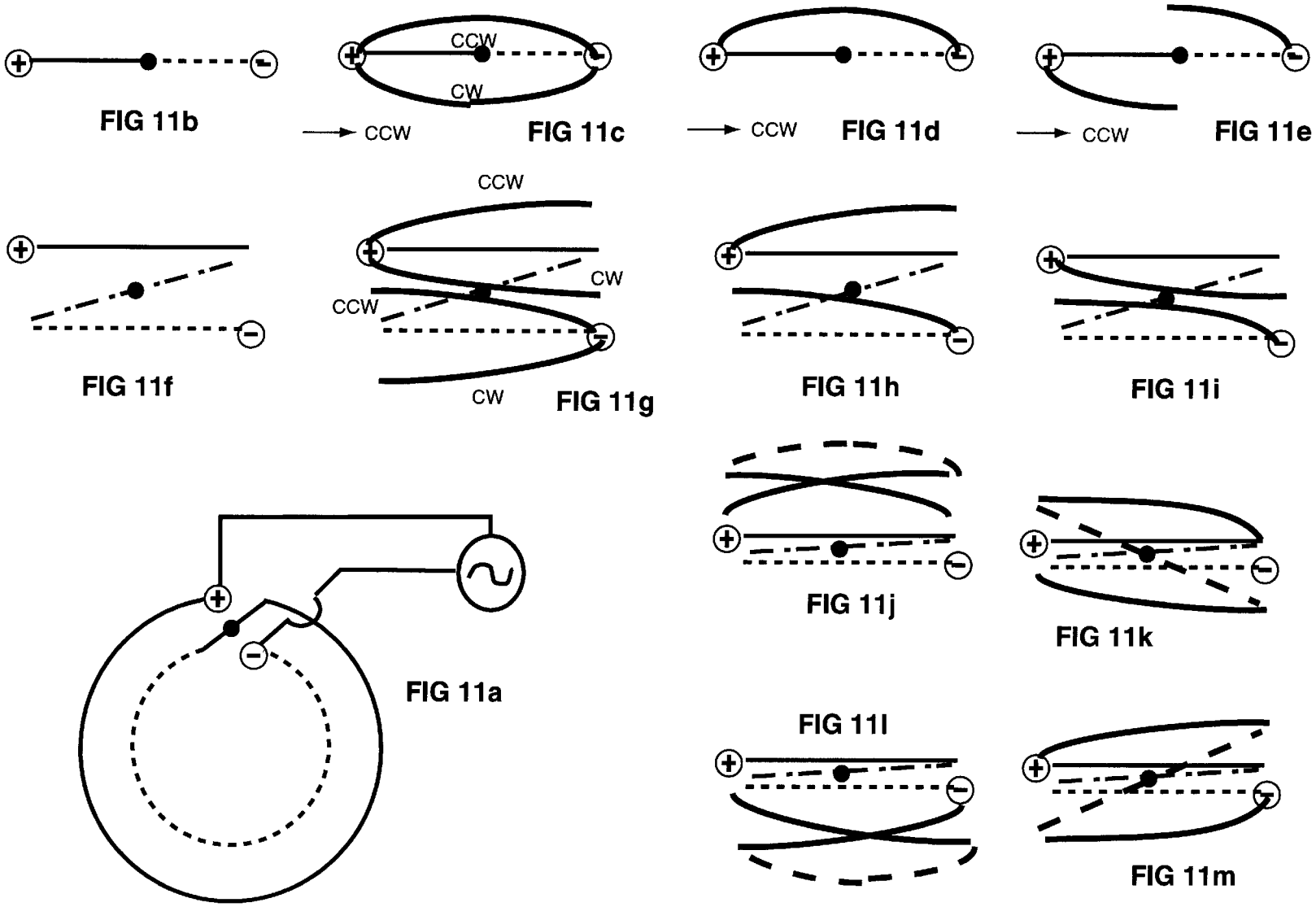
FIG. 11 is a schematic representation of a multi-layer (2-layer) toroidal helical antenna embodiment divided into first and second length portions joined to one another wherein the first length portion is a left-hand pitch sense helix and the second length portion is a right-hand pitch sense helix, wherein each layer spans the entire circumferential length of the underlying generalized toroidal form, series fed at a resonant frequency according to a first signal feed configuration wherein at the depicted instant of time the first signal feed terminal, connected to the first length portion, is positive with respect to the second signal feed terminal, connected to the second length portion; also known as the multi-layer "PSD" configuration.
Figures 12A, 12B, 12C, 12D, 12E, 12F, 12G, 12H, 12I, 12J, 12K, 12L, 12M:
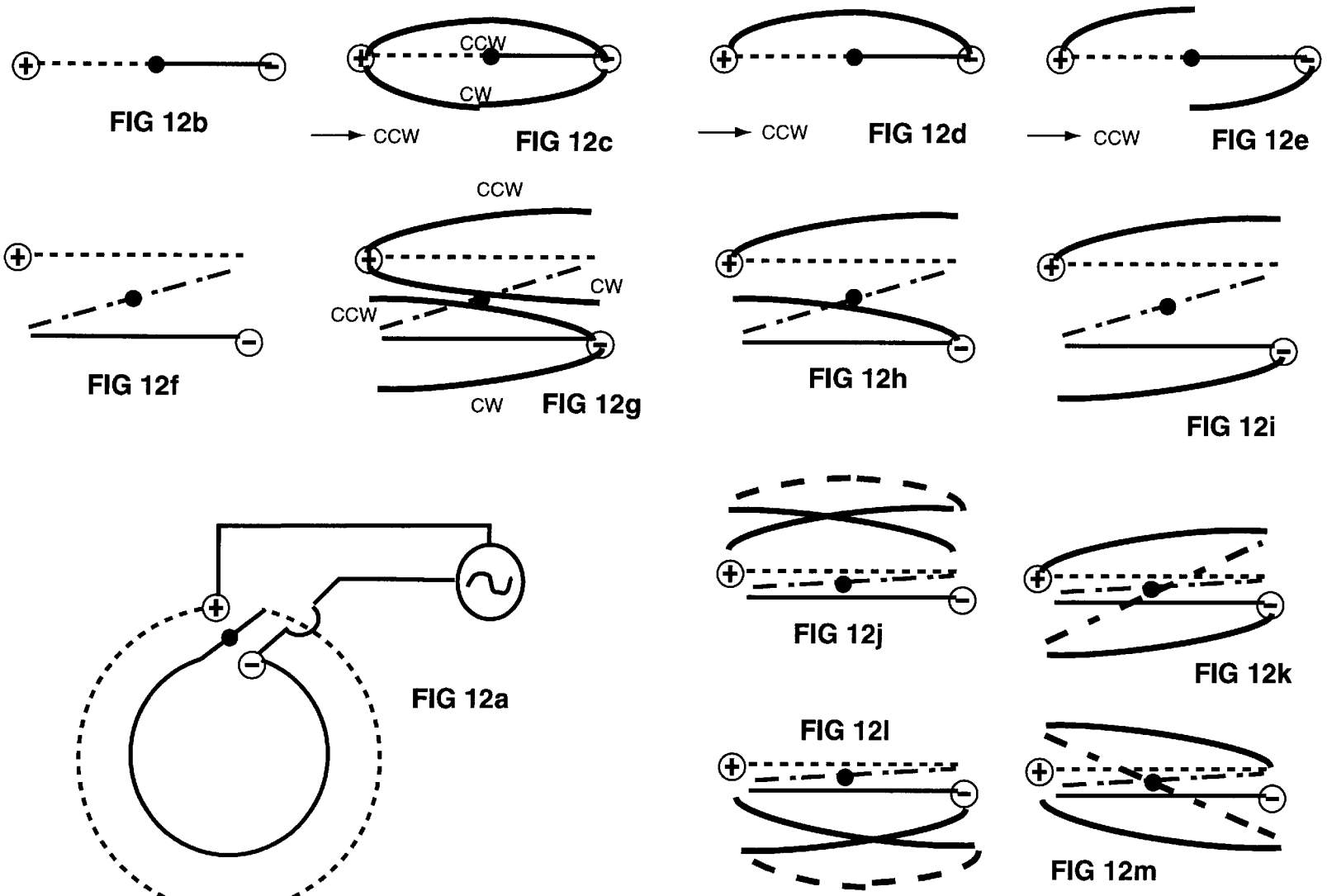
FIG. 12 is a schematic representation of a multi-layer (2-layer) toroidal helical antenna embodiment divided into first and second length portions joined to one another wherein the first length portion is a right-hand pitch sense helix and the second length portion is a left-hand pitch sense helix, wherein each layer spans the entire circumferential length of the underlying generalized toroidal form, series fed at a resonant frequency according to a first signal feed configuration wherein at the depicted instant of time the first signal feed terminal, connected to the first length portion, is positive with respect to the second signal feed terminal, connected to the second length portion; also known as the multi-layer "PDS" configuration.
Figures 13A, 13B, 13C, 13D, 13E, 13F, 13G, 13H, 13I, 13J, 13K, 13L, 13M:
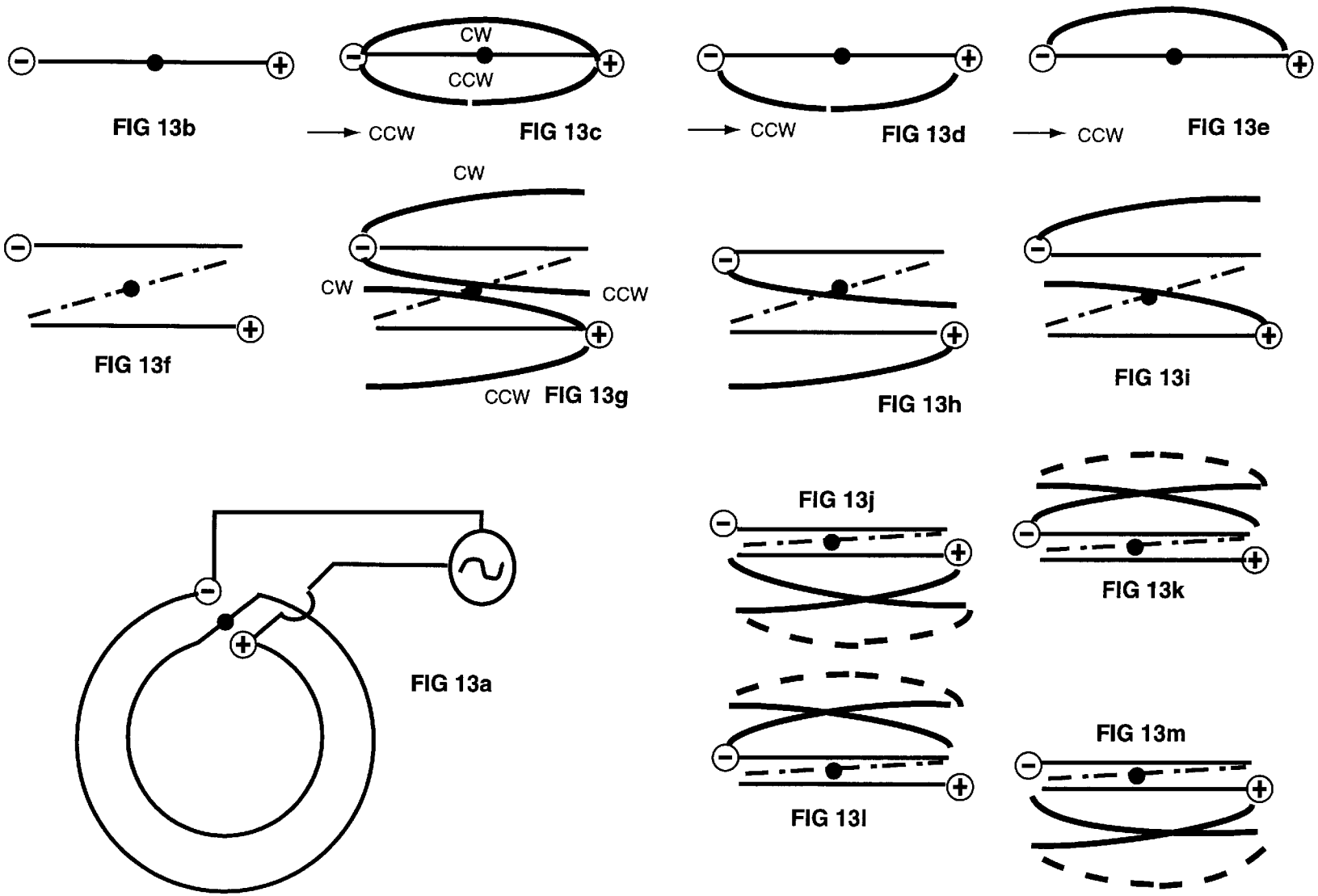
FIG. 13 is a schematic representation of a multi-layer (2-layer) uniform left-hand pitch sense toroidal helical antenna embodiment, wherein each layer spans the entire circumferential length of the underlying generalized toroidal form, series fed at a resonant frequency according to a second signal feed configuration wherein at the depicted instant of time the first signal feed terminal is negative with respect to the second signal feed terminal; also known as the multi-layer "NSS" configuration.
Figures 14A, 14B, 14C, 14D, 14E, 14F, 14G, 14H, 14I, 14J, 14K, 14L, 14M:
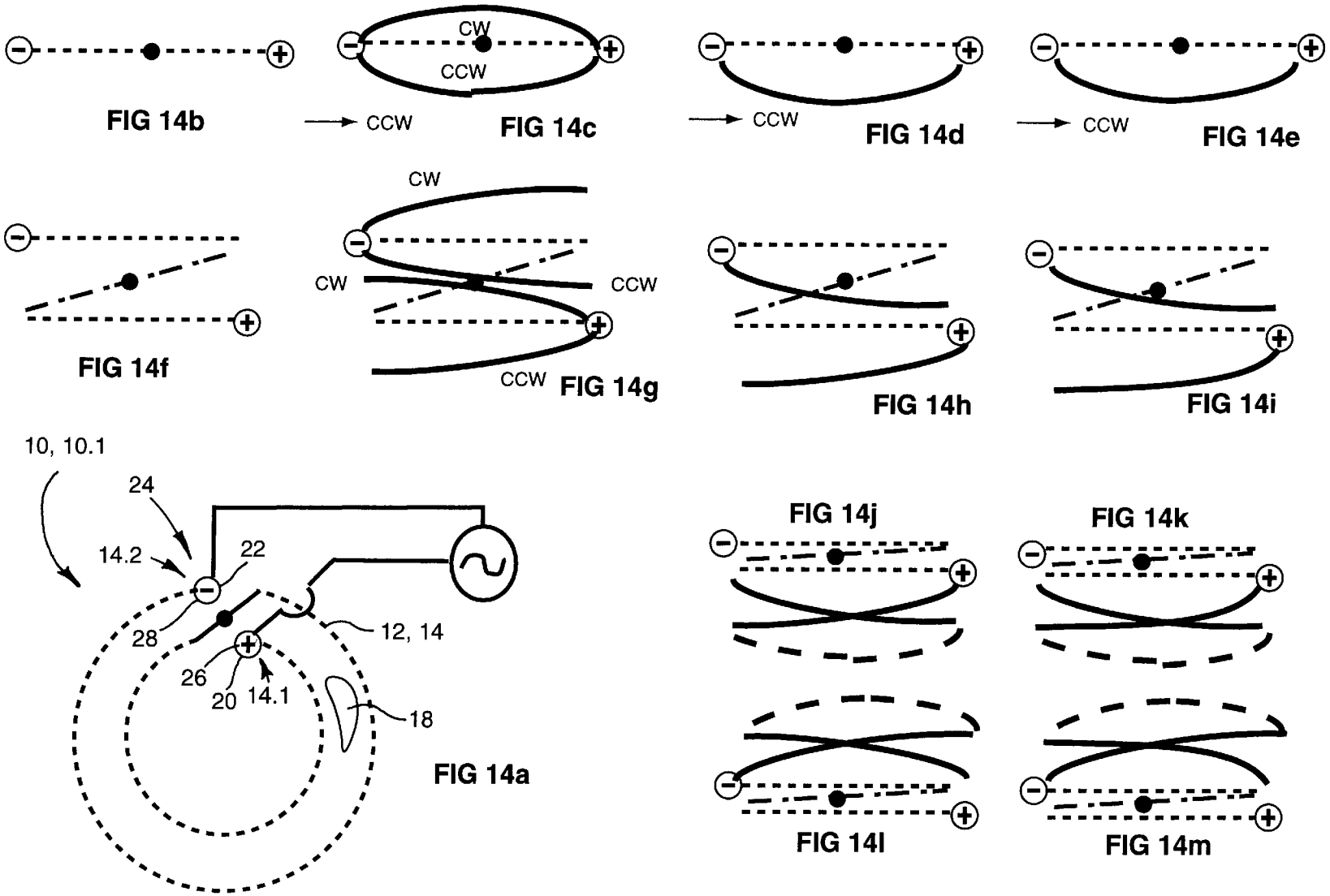
FIG. 14 is a schematic representation of a multi-layer (2-layer) uniform right-hand pitch sense toroidal helical antenna embodiment, wherein each layer spans the entire circumferential length of the underlying generalized toroidal form, series fed at a resonant frequency according to a second signal feed configuration wherein at the depicted instant of time the first signal feed terminal is negative with respect to the second signal feed terminal; also known as the multi-layer "NDD" configuration.
Figures 15A, 15B, 15C, 15D, 15E, 15F, 15G, 15H, 15I, 15J, 15K, 15L, 15M:
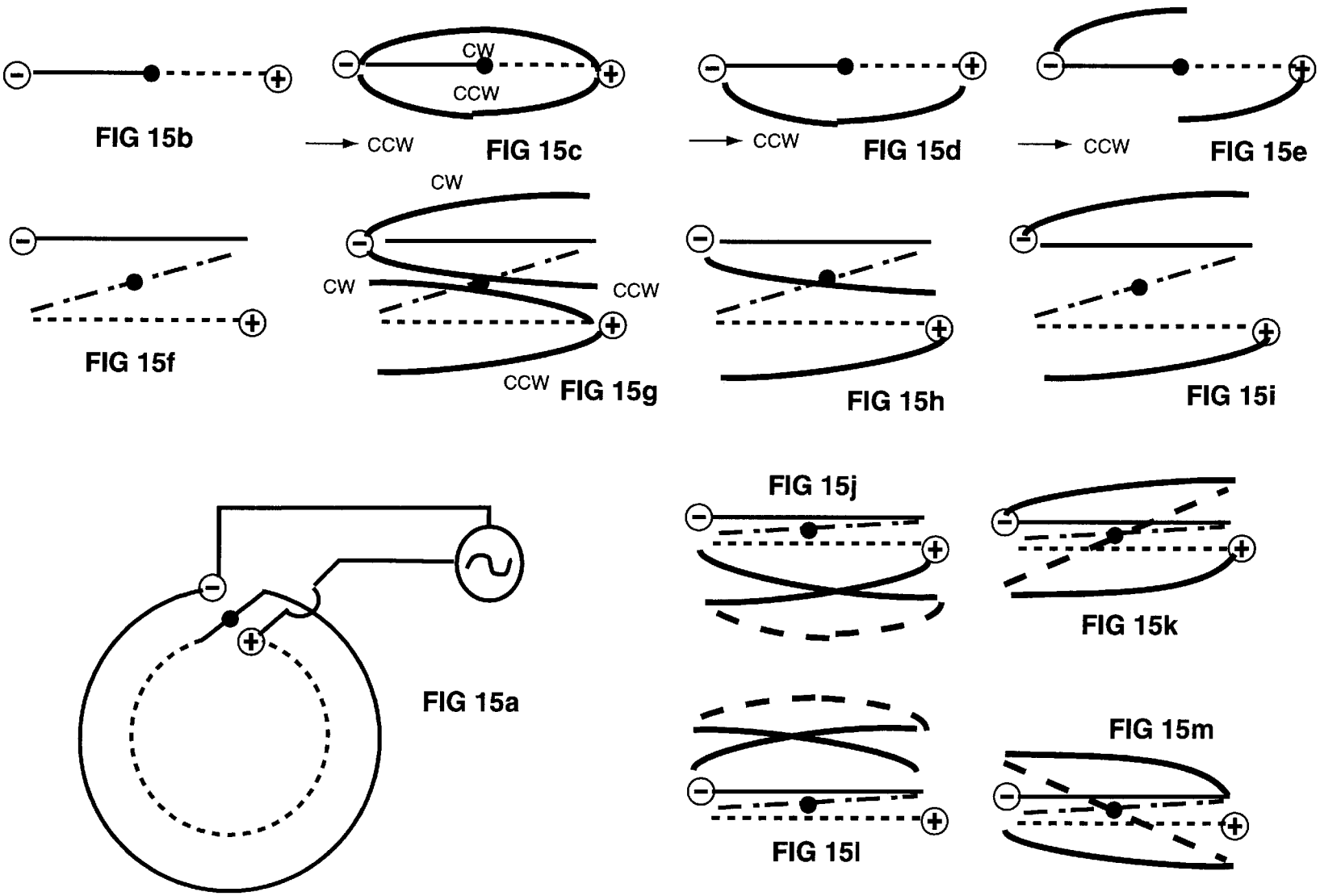
FIG. 15 is a schematic representation of a multi-layer (2-layer) toroidal helical antenna embodiment divided into first and second length portions joined to one another wherein the first length portion is a left-hand pitch sense helix and the second length portion is a right-hand pitch sense helix, wherein each layer spans the entire circumferential length of the underlying generalized toroidal form, series fed at a resonant frequency according to a second signal feed configuration wherein at the depicted instant of time the first signal feed terminal, connected to the first length portion, is negative with respect to the second signal feed terminal, connected to the second length portion; also known as the multi-layer "NSD" configuration.
Figures 16A, 16B, 16C, 16D, 16E, 16F, 16G, 16H, 16I, 16J, 16K, 16L, 16M:
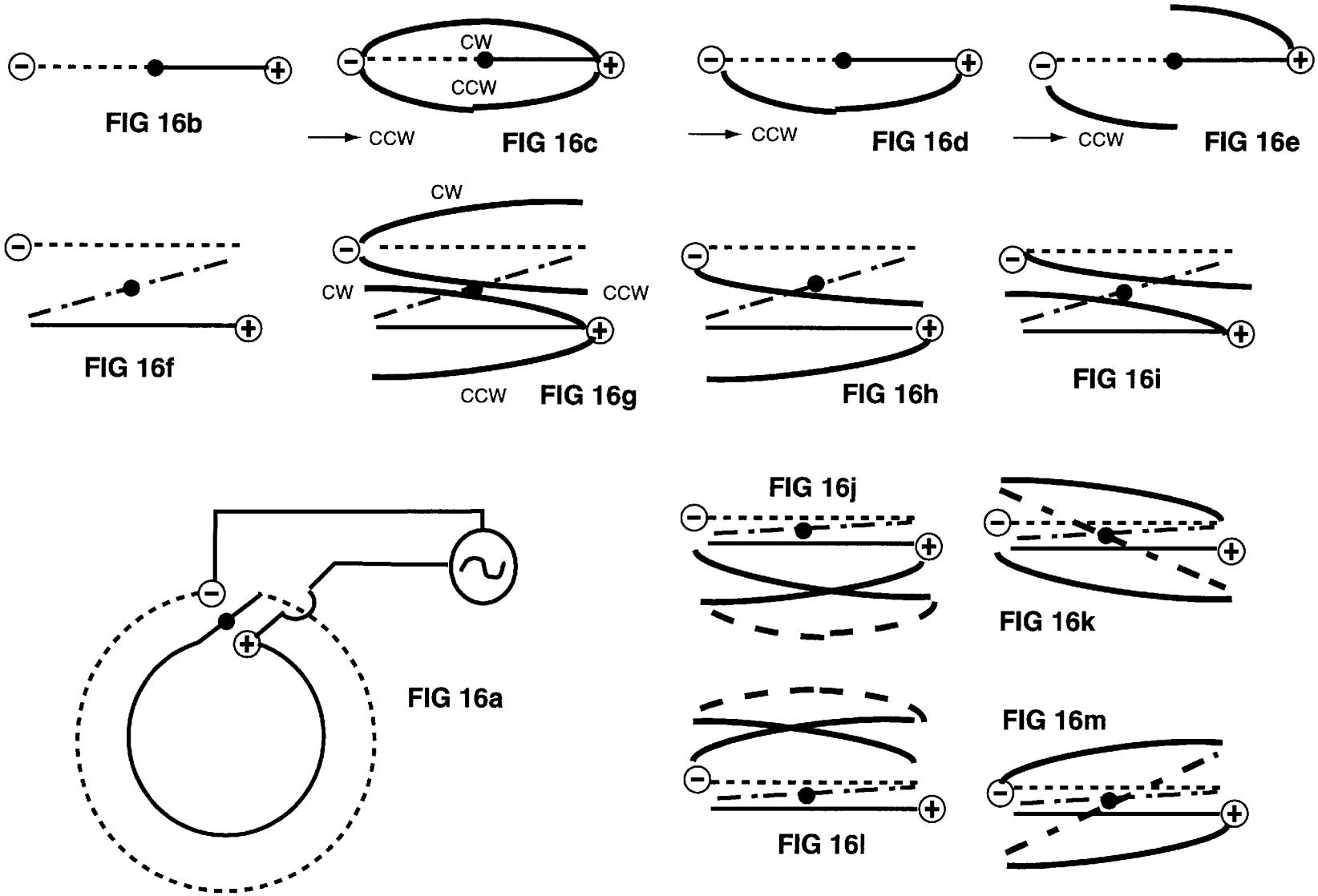
FIG. 16 is a schematic representation of a multi-layer (2-layer) toroidal helical antenna embodiment divided into first and second length portions joined to one another wherein the first length portion is a right-hand pitch sense helix and the second length portion is a left-hand pitch sense helix, wherein each layer spans the entire circumferential length of the underlying generalized toroidal form, series fed at a resonant frequency according to a second signal feed configuration wherein at the depicted instant of time the first signal feed terminal, connected to the first length portion, is negative with respect to the second signal feed terminal, connected to the second length portion; also known as the multi-layer "NDS" configuration.

FIGS. 1–16 illustrate various elementary toroidal helical and contrawound toroidal helical embodiments which either constitute or are incorporated into the instant invention. FIGS. 1–8 illustrate single layer embodiments wherein helical winding essentially extends once around the circumference of the minor axis of the associated underlying generalized toroidal form. FIGS. 9–16 illustrate multi-layer embodiments, and more particularly two layer embodiments, wherein helical winding essentially extends twice, and more generally at least twice, around the circumference of the minor axis of the associated underlying generalized toroidal form.

In FIGS. 1–16, frame a schematically illustrates the physical geometry of the antenna, the associated signal source, and the connection thereof to the antenna. Frame b schematically illustrates the associated developed linear geometry of the antenna. The symbol "●" on the physical and developed geometries represents the point of delineation between the first and second length portions of the single conductor, which for the FIGS. 1–8 embodiments is approximately diametrically opposite the associated feed point along the circumference of the minor axis of the associated generalized toroidal form, and which for the FIGS. 9–16 embodiments is approximately aligned with the associated feed point along the circumference of the minor axis of the associated generalized toroidal form. Frame c schematically illustrates the electric current distribution overlaying the developed linear geometry at the instant of time when the signal is polarized as shown in frame a, wherein the current waveforms are shown with respect to their respective directions of propagation on the antenna, either clockwise, "CW", or counter clockwise "CCW. Frame d schematically illustrates the associated effective counter clockwise electric current distribution overlaying the developed linear geometry. Frame e schematically illustrates the associated effective counter-clockwise magnetic current distribution overlaying the developed linear geometry wherein the magnetic current is given as the time derivative of the associated magnetic B field which direction relative to the projected circumferential direction of the associated electric current is according to the associated helical pitch sense.

In FIGS. 9–16, frame f schematically illustrates the associated developed linear geometry of the antenna folded onto the circumference of the minor axis of the associated generalized toroidal form, thereby more closely corresponding to the physical embodiment for purposes of illustrating the spatial phase relationships of the associated electric and magnetic current distributions. Frame g schematically illustrates the electric current distribution overlaying the folded developed linear geometry at the instant of time when the signal is polarized as shown in frame a, wherein the current waveforms are shown with respect to their respective directions of propagation on the antenna, either clockwise, "CW", or counter clockwise "CCW. Frame h schematically illustrates the associated effective counter clockwise electric current distribution overlaying the folded developed linear geometry. Frame i schematically illustrates the associated effective counter-clockwise magnetic current distribution overlaying the folded developed linear geometry wherein the magnetic current is given as the time derivative of the associated magnetic B field which direction relative to the projected circumferential direction of the associated electric current is according to the associated helical pitch sense. Frames j and k are alternate representations of frames h and i respectively, where the dashed curve represents the composite current distribution. Frames l and m are representations of Frames j and k at a point in time when the signal polarity is reversed.

It will be appreciated by one with ordinary skill in the art that a single conductor or single conductive path may comprise a variety of embodiments, including but not limited to a single-element conductor comprising a wire, foil or printed circuit element, each of arbitrary cross section, either solid or hollow; a multi-element conductor comprising a plurality of non-insulated single-element conductors; or a plurality of single-element conductors or multi-element conductors which are insulated from one another; such that a signal applied across two nodes defined at distinct locations along the single conductor is applied across each such conductive element thereof, thereby causing a current to flow in each such element in accordance with Ohm's law. The aforementioned single-element conductor may further comprise a variety of embodiments, including but not limited to a homogeneous or stratified conductive medium, or one or more segments of distinct homogeneous or stratified conductive media conductively joined to one another.

Tables 1a and 2a tabulate the characteristics of the electric and magnetic current distributions for FIGS. 1–8 and 9–16 respectively, where "+1" or "−1" indicate the polarity of associated unipolar distributions, and "−+" and "+−" indicate the polarities of associated bipolar distributions, where the order is given as left to right (counter-clockwise on the physical embodiment) with reference to frame b. The three character naming convention, e.g. "PSS", for the embodiments of FIGS. 1–16 is also given with reference to frame b, wherein the first character , "P" or "N", represents the polarity of the first signal terminal (left-most), and the second and third characters, each "S" or "D", refer to the helical pitch sense of the first side of frame b) and second length (right side of frame b) portions with "S" corresponding to a left-hand pitch sense helix schematically represented by a solid line, and with "D" corresponding to a right-hand pitch sense helix schematically represented by a dashed line.

TABLE 1a

| FIG | | CCW E | CCW M |
|---|---|---|---|
| 1 | PSS | 1 | −1 |
| 2 | PDD | 1 | 1 |
| 3 | PSD | 1 | −+ |
| 4 | PDS | 1 | +− |
| 5 | NSS | −1 | 1 |
| 6 | NDD | −1 | −1 |
| 7 | NSD | −1 | +− |
| 8 | NDS | −1 | −+ |

TABLE 2a

| FIG | | CCW E | CCW M |
|---|---|---|---|
| 9 | PSS | 1 | −1 |
| 10 | PDD | 1 | 1 |
| 11 | PSD | 1 | +− |
| 12 | PDS | 1 | −+ |
| 13 | NSS | −1 | 1 |
| 14 | NDD | −1 | −1 |
| 15 | NSD | −1 | −+ |
| 16 | NDS | −1 | +− |

Table 1b tabulates the characteristics of the composite electric current distribution for all combinations of the associated FIGS. 1–8 embodiments with one another, whereby combinations of the PSS, PDD, PSD and PDS embodiments with one another provide a net positive unipolar circumferential electric current distribution; combinations of the NSS, NDD, NCD, and NDS embodiments with one another provide a net negative unipolar circumferential electric current distribution, and combinations of the PSS, PDD, PSD, and PDS embodiment with the NSS, NDD, NSD, and NDS embodiments provide an effective cancellation of the circumferential electric current distribution; whereby the respective polarities are referenced to the signal polarity at the instant of time illustrated in FIGS. 1–8. Table 2b provides a similar tabulation for the multi-layer embodiments with similar results.

TABLE 1b

| FIG | FIG CCW_ E | 1 P SS | 2 P DD | 3 P SD | 4 P DS | 5 N SS | 6 N DD | 7 N SD | 8 N DS |
|---|---|---|---|---|---|---|---|---|---|
| 1 | PSS | 2 | | | | | | | |
| 2 | PDD | 2 | 2 | | | | | | |
| 3 | PSD | 2 | 2 | 2 | | | | | |
| 4 | PDS | 2 | 2 | 2 | 2 | | | | |
| 5 | NSS | 0 | 0 | 0 | 0 | −2 | | | |
| 6 | NDD | 0 | 0 | 0 | 0 | −2 | −2 | | |
| 7 | NSD | 0 | 0 | 0 | 0 | −2 | −2 | −2 | |
| 8 | NDS | 0 | 0 | 0 | 0 | −2 | −2 | −2 | −2 |

TABLE 2b

| FIG | FIG CCW_ E | 9 P SS | 10 P DD | 11 P SD | 12 P DS | 13 N SS | 14 N DD | 15 N SD | 16 N DS |
|---|---|---|---|---|---|---|---|---|---|
| 9 | PSS | 2 | | | | | | | |
| 10 | PDD | 2 | 2 | | | | | | |
| 11 | PSD | 2 | 2 | 2 | | | | | |
| 12 | PDS | 2 | 2 | 2 | 2 | | | | |
| 13 | NSS | 0 | 0 | 0 | 0 | −2 | | | |
| 14 | NDD | 0 | 0 | 0 | 0 | −2 | −2 | | |

TABLE 2b-continued

| FIG | FIG CCW_ E | 9 P SS | 10 P DD | 11 P SD | 12 P DS | 13 N SS | 14 N DD | 15 N SD | 16 N DS |
|---|---|---|---|---|---|---|---|---|---|
| 15 | NSD | 0 | 0 | 0 | 0 | −2 | −2 | −2 | |
| 16 | NDS | 0 | 0 | 0 | 0 | −2 | −2 | −2 | −2 |

Table 1c and 2c tabulate the characteristics of the composite magnetic current distributions for the same combination of antenna elements as tabulated in Tables 1b and 2b entries in Tables 1c and 2c are color coded according to their respective characteristic behavior, with the color yellow representing a net cancellation of the circumferential magnetic current distribution, the color red representing a positive unipolar circumferential magnetic current distribution, and the color blue representing a negative unipolar circumferential magnetic current distribution. The color coding of Tables 1c and 2c superimposed on Tables 1b, 1d, 1e, and 1f and Tables 2b, 2d, 2e, and 2f respectively.

TABLE 1c

| FIG | FIG CCW_ M | 1 P SS | 2 P DD | 3 P SD | 4 P DS | 5 N SS | 6 N DD | 7 N SD | 8 N DS |
|---|---|---|---|---|---|---|---|---|---|
| 1 | PSS | −2 | | | | | | | |
| 2 | PDD | 0 | 2 | | | | | | |
| 3 | PSD | −+ | −+ | −+ | | | | | |
| | | −1 | 1 | −+ | | | | | |
| 4 | PDS | +− | +− | +− | +− | | | | |
| | | −1 | 1 | −+ | +− | | | | |
| 5 | NSS | 0 | 2 | 1− | 1 | 2 | | | |
| | | | | + | +− | | | | |
| 6 | NDD | −2 | 0 | −1− | −1 | 0 | −2 | | |
| | | | | + | +− | | | | |
| 7 | NSD | +− | +− | +− | +− | +− | +− | +− | |
| | | −1 | 1 | −+ | +− | 1 | −1 | +− | |
| 8 | NDS | −+ | −+ | −+ | −+ | −+ | −+ | −+ | −+ |
| | | −1 | 1 | −+ | +− | 1 | −1 | +− | −+ |

TABLE 2c

| FIG | FIG CCW_ M | 9 P SS | 10 P DD | 11 P SD | 12 P DS | 13 N SS | 14 N DD | 15 N SD | 16 N DS |
|---|---|---|---|---|---|---|---|---|---|
| 9 | PSS | −2 | | | | | | | |
| 10 | PDD | 0 | 2 | | | | | | |
| 11 | PSD | +− | +− | +− | | | | | |
| | | −1 | 1 | +− | | | | | |
| 12 | PDS | −+ | −+ | −+ | −+ | | | | |
| | | −1 | 1 | +− | −+ | | | | |
| 13 | NSS | 0 | 2 | 1 | 1− | 2 | | | |
| | | | | +− | + | | | | |
| 14 | NDD | −2 | 0 | −1 | −1− | 0 | −2 | | |
| | | | | +− | + | | | | |
| 15 | NSD | −+ | −+ | −+ | −+ | −+ | −+ | −+ | |
| | | −1 | 1 | +− | −+ | 1 | −1 | −+ | |
| 16 | NDS | +− | +− | +− | +− | +− | +− | +− | +− |
| | | −1 | 1 | +− | −+ | 1 | −1 | −+ | +− |

Tables 1d and 2d tabulate the figure (FIG.) numbers of the associated antenna element combinations, and Tables 1e and 2e tabulate the names of the associated antenna element combinations. Tables 1f and 2f tabulate the names of the associated antenna element combinations as a function of the characteristics of the associated electric and magnetic current distribution.

TABLE 1d

| | | FIG | | | | | | | |
|---|---|---|---|---|---|---|---|---|---|
| FIG | FIG | 1 PSS | 2 PDD | 3 PSD | 4 PDS | 5 NSS | 6 NDD | 7 NSD | 8 NDS |
| 1 | PSS | | | | | | | | |
| 2 | PDD | 2_1 | 2 | | | | | | |
| 3 | PSD | 3_1 | 3_2 | 3 | | | | | |
| 4 | PDS | 4_1 | 4_2 | 4_3 | 4 | | | | |
| 5 | NSS | 5_1 | 5_2 | 5_3 | 5_4 | 5 | | | |
| 6 | NDD | | 6_2 | 6_3 | 6_4 | 6_5 | 6 | | |
| 7 | NSD | 7_1 | 7_2 | 7_3 | 7_4 | 7_5 | 7_6 | 7 | |
| 8 | NDS | 8_1 | 8_2 | 8_3 | 8_4 | 8_5 | 8_6 | 8_7 | 8 |

TABLE 2d

| | | FIG | | | | | | | |
|---|---|---|---|---|---|---|---|---|---|
| FIG | FIG | 9 PSS | 10 PDD | 11 PSD | 12 PDS | 13 NSS | 14 NDD | 15 NSD | 16 NDS |
| 9 | PSS | 9 | | | | | | | |
| 10 | PDD | 10_9 | 10 | | | | | | |
| 11 | PSD | 11_9 | 11_10 | 11 | | | | | |
| 12 | PDS | 12_9 | 12_10 | 12_11 | 12 | | | | |
| 13 | NSS | 13_9 | 13_10 | 13_11 | 13_12 | 13 | | | |
| 14 | NDD | 14_9 | 14_10 | 14_11 | 14_12 | 14_13 | 14 | | |
| 15 | NSD | 15_9 | 15_10 | 15_11 | 15_12 | 15_13 | 15_14 | 15 | |
| 16 | NDS | 16_9 | 16_10 | 16_11 | 16_12 | 16_13 | 16_14 | 16_15 | 16 |

TABLE 1E

| | | FIG | | | | | | | |
|---|---|---|---|---|---|---|---|---|---|
| FIG | | 1 PSS | 2 PDD | 3 PSD | 4 PDS | 5 NSS | 6 NDD | 7 NSD | 8 NDS |
| 1 | PSS | | | | | | | | |
| 2 | PDD | PDD_PSS | PDD_PDD | | | | | | |
| 3 | PSD | PSD_PSS | PSD_PDD | PSD_PSD | | | | | |
| 4 | PDS | PDS_PSS | PDS_PDD | PDS_PSD | PDS_PDS | | | | |
| 5 | NSS | NSS_PSS | NSS_PDD | NSS_PSD | NSS_PDS | NSS_NSS | | | |
| 6 | NDD | | NDD_PDD | NDD_PSD | NDD_PDS | NDD_NSS | | | |
| 7 | NSD | NSD_PSS | NSD_PDD | NSD_PSD | NSD_PDS | NSD_NSS | NSD_NDD | NSD_NSD | |
| 8 | NDS | NDS_PSS | NDS_PDD | NDS_PSD | NDS_PDS | NDS_NSS | NDS_NDD | NDS_NSD | NDS_NDS |

TABLE 2e

| | | FIG | | | | | | | |
|---|---|---|---|---|---|---|---|---|---|
| FIG | | 9 PSS | 10 PDD | 11 PSD | 12 PDS | 13 NSS | 14 NDD | 15 NSD | 16 NDS |
| 9 | PSS | | | | | | | | |
| 10 | PDD | PDD_PSS | PDD_PDD | | | | | | |
| 11 | PSD | PSD_PSS | PSD_PDD | PSD_PSD | | | | | |
| 12 | PDS | PDS_PSS | PDS_PDD | PDS_PSD | PDS_PDS | | | | |
| 13 | NSS | NSS_PSS | NSS_PDD | NSS_PSD | NSS_PDS | NSS_NSS | | | |
| 14 | NDD | | NDD_PDD | NDD_PSD | NDD_PDS | NDD_NSS | | | |
| 15 | NSD | NSD_PSS | NSD_PDD | NSD_PSD | NSD_PDS | NSD_NSS | NSD_NDD | NSD_NSD | |
| 16 | NDS | NDS_PSS | NDS_PDD | NDS_PSD | NDS_PDS | NDS_NSS | NDS_NDD | NDS_NSD | NDS_NDS |

TABLE 1f

| CCW_ | CCW_E | | | |
|---|---|---|---|---|
| M | 2 | 0 | | −2 |
| 2 | PDD | NSS_PDD | | NSS |
| −2 | PSS | NDD_PSS | | NDD |
| 0 | PDD_PSS | NSS_PSS | NDD_PDD | NDD_NSS |
| 0 | PDS_PSD | NSD_PSD | NDS_PDS | NDS_NSD |
| −+ −1 | PSD_PSS | NDS_PSS | NDD_PSD | NDS_NDD |
| +− −1 | PDS_PSS | NSD_PSS | NDD_PDS | NSD_NDD |
| −+ 1 | PSD_PDD | NDS_PDD | NSS_PSD | NDS_NSS |
| +− 1 | PDS_PDD | NSS_PDS | NSD_PDD | NSD_NSS |
| −+ −+ | PSD | NDS_PSD | | NDS |
| +− +− | PDS | NSD_PDS | | NSD |

TABLE 2f

| CCW_ | CCW_E | | | |
|---|---|---|---|---|
| M | 2 | 0 | | −2 |
| 2 | PDD | NSS_PDD | | NSS |
| −2 | PSS | NDD_PSS | | NDD |
| 0 | PDD_PSS | NSS_PSS | NDD_PDD | NDD_NSS |
| 0 | PDS_PSD | NSD_PSD | NDS_PDS | NDS_NSD |
| +− −1 | PSD_PSS | NDS_PSS | NDD_PSD | NDS_NDD |
| −+ −1 | PDS_PSS | NSD_PSS | NDD_PDS | NSD_NDD |
| +− 1 | PSD_PDD | NDS_PDD | NSS_PSD | NDS_NSS |
| −+ 1 | PDS_PDD | NSS_PDS | NSD_PDD | NSD_NSS |
| +− +− | PSD | NDS_PSD | | NDS |
| −+ −+ | PDS | NSD_PDS | | NSD |

In an exemplary embodiment, an electromagnetic antenna 10 is formed by combining the embodiments illustrated in FIGS. 9 (10.1) and 14 (10.2), wherein a continuous conductor 12 comprises a first length portion 14 and a second length portion 16, the first and second length portions each having a first end and a second end, the first end 14.1 of the first length portion 14 connected to the second end 16.2 of the second length portion 16 at a first node 20, and the second end 14.2 of the first length portion is connected to the first end of the second length portion 16.1 at a second node 22. The continuous conductor 12 extends in a generalized helical pattern as a single closed circuit around and over the surface of a generalized toroid 18, whereby the first length portion 14 thereof has a first helical pitch sense and extends around the major axis of the generalized toroid for a first plurality of turns, and the generalized helical pattern of the second length portion thereof has a second helical pitch sense and extends around the major axis of the generalized toroid for a second plurality of turns, whereby the first and second helical pitch senses are opposite one another. The first and second pluralities are preferably equal to one another, and are both equal to two (2) for the embodiment of FIGS. 9/14. The first 14 and second 16 length portions of the continuous conductor are generally contrawound relative to one another, are insulated from one another and overlap one another. The first and second nodes are in proximate location to one another and collectively constitute a port 24. A signal feed is operatively connected to the port, and first 26 and second 28 signal terminals are operatively connected to the signal feed.

One of ordinary skill in the art, either by familiarity with existing antenna architectures which produce similar current distributions, or by use of simulations or tests, will be able to appreciate the nature of the electromagnetic radiation patterns and characteristics associated with each of the current distributions and composite current distributions illustrated in FIGS. 1–16 and Tables 1 and 2.

The various embodiments of the instant invention will have preferable input impedance characteristics, wherein the first resonance will be characterized by high impedance, high bandwidth, and smallest electrical size relative to the next higher resonance order. The single layer embodiments will be preferably a half-wavelength in electrical circumference, whereas the 2-layer embodiments will be preferably a quarter wavelength in electrical circumference. In addition to being half the electrical size, the 2-layer embodiments also provide for more uniform electric and magnetic current distributions.

Each of the embodiments is preferably fed at a single port. An impedance matching network may be required to adapt the resonant impedance of the antenna to that of the associated transmission line.

The antennas are constructed by forming a single conductor around the surface of a real or virtual generalized torus to form a generalized toroidal helical winding, the characteristics of which are taught in the '353 Patent. The generalized torus as taught in the '353 Patent, and as taught herein, includes both cylindrical toroidal geometries and geometries formed by creating a central core in a sphere, and includes configurations where a portion of the helical winding is primarily radial relative to the major axis of the underlying generalized toroidal form. The generalized torus as taught herein includes the degenerate cases where the major axis is smaller than the minor axis, including cases where the surface is a sphere, cylinder, or prism, and associated image plane embodiments, all of which are illustrated in U.S. Pat. No. 5,654,723.

While specific embodiments have been described in detail, those with ordinary skill in the art will appreciate that various modifications and alternatives to those details could be developed in light of the overall teachings of the disclosure. Accordingly, the particular arrangements disclosed are meant to be illustrative only and not limiting as to the scope of the invention, which is to be given the full breadth of of the appended claims and any and all equivalents thereof.

I claim:

1. An electromagnetic antenna comprising:

(a) a continuous conductor comprising a first length portion and a second length portion, said first and second length portions each having a first end and a second end, said first end of said first length portion connected to said second end of said second length portion at a first node, said second end of said first length portion connected to said first end of said second length portion at a second node;

(b) a generalized toroid having a major axis and a minor axis, said continuous conductor extending in a generalized helical pattern as a single closed circuit around and over the surface of said generalized toroid, said generalized helical pattern of said first length portion of said continuous conductor having a first helical pitch sense and extending around said major axis for a first plurality of turns, said generalized helical pattern of said second length portion of said continuous conductor having a second helical pitch sense and extending around said major axis for a second plurality of turns, said first and second pluralities equal, said first helical pitch sense being opposite to said second helical pitch sense, said first and second length portions of said continuous conductor insulated from one another and overlapping one another, whereby said first and second nodes are in proximate location to one another and collectively constitute a port;

(c) a signal feed operatively connected to said port, and (d) first and second signal terminals operatively connected to said signal feed.

2. An electromagnetic antenna as recited in claim 1, wherein said first length portion of said conductor extends around said major axis in a first direction from said first node to said second node, said second length portion of said conductor extends around said major axis in a second direction from said first node to said second node, and said first direction is opposite to said second direction.

3. An electromagnetic antenna as recited in claim 1, wherein said first length portion of said conductor extends around said major axis in a first direction from said first node to said second node, said second length portion of said conductor extends around said major axis in a second direction from said first node to said second node, and said first direction is the same as said second direction.

4. An electromagnetic antenna comprising:

(a) a generalized toroid having a major axis and a minor axis;

(b) a conductive path comprising a first length portion and a second length portion, said first and second length portions each having a first end and a second end, said second end of said first length portion connected to said first end of said second length portion at a first node, said conductive path extending in a generalized helical pattern around and over the surface of said generalized toroid, said generalized helical pattern of said first length portion of said conductive path having a first helical pitch sense and extending partially around said major axis, said generalized helical pattern of said second length portion of said conductive path having a second helical pitch sense and extending partially around said major axis, said first helical pitch sense being opposite to said second helical pitch sense; and (c) first and second signal terminals, wherein said first signal terminal is operatively connected to said first end of said first length portion of said conductive path and said second signal terminal is operatively connected to said second end of said second length portion of said conductive path.

5. An electromagnetic antenna comprising:

(a) a generalized toroid having a major axis and a minor axis;

(b) a conductive path having a first end and a second end, said conductive path extending in a generalized helical pattern around and over the surface of said generalized toroid, said generalized helical pattern of said conductive path having a helical pitch sense and extending around said major axis for a plurality of turns; and (c) first and second signal terminals, wherein said first signal terminal is operatively connected to said first end of said conductive path and said second signal terminal is operatively connected to said second end of said conductive path.

* * * * *